US005463780A

United States Patent [19]

McAllister et al.

[11] Patent Number: 5,463,780

[45] Date of Patent: Nov. 7, 1995

[54] RAMP FOR BARRIER-FREE SHOWERS

[75] Inventors: George P. McAllister, Jr., Franklin; Donnie L. Harris, Fairview, both of Tenn.

[73] Assignee: Aqua Bath Company, Inc., Nashville, Tenn.

[21] Appl. No.: 283,812

[22] Filed: Aug. 1, 1994

[51] Int. Cl.[6] ..... A47K 3/22

[52] U.S. Cl. ..... 4/604; 4/555

[58] Field of Search ..... 4/555, 556, 604, 4/611

[56] References Cited

U.S. PATENT DOCUMENTS

| | | | |
|---|---|---|---|
| 2,075,933 | 4/1937 | Friedlander | 4/556 |
| 2,576,623 | 11/1951 | McLaughlin | 4/555 |
| 4,757,561 | 7/1988 | Crump | 4/604 |
| 4,993,087 | 2/1991 | Rogueburne | 4/604 |

FOREIGN PATENT DOCUMENTS

| | | | |
|---|---|---|---|
| 1582900 | 1/1981 | United Kingdom | 4/555 |

*Primary Examiner*—Charles E. Phillips
*Attorney, Agent, or Firm*—B. Craig Killough

[57] ABSTRACT

A ramp for barrier free showers which is pivotable from a generally horizontal position for elevating wheel chairs into a shower or other location, to a generally vertical position which removes the ramp as a hazard and which uses the ramp to hold shower curtains within the shower. The ramp has a dam which extends generally perpendicularly front the top surface of the ramp and which covers a gap between the ramp and a threshold of the shower when the ramp is in the generally vertical position, to prevent water from running onto the floor.

12 Claims, 2 Drawing Sheets

RAMP FOR BARRIER-FREE SHOWERS

FIELD OF THE PRESENT INVENTION

This invention relates to barrier-free showers, and is more particular related to a ramp which may be used to facilitate ingress and egress of wheelchairs with such showers.

BACKGROUND OF THE PRESENT INVENTION

Barrier-free showers are defined as showers which have an opening of sufficient size to allow ingress and egress of wheelchairs. Barrier free showers may be of sufficient size to allow the presence of a wheelchair within the shower. Barrier-free showers may have a seat formed within the shower on which the user may be seated after exiting the wheelchair, or a fold up seat could be provided.

In use, a user is placed within the barrier-free shower by means of the wheelchair, The user exits the wheelchair and sits on the seat within the shower, or the user may sit within the wheel chair in larger showers. If the wheel chair has been removed, then after the showering process is complete, the wheelchair is again placed within the shower, and the user is seated in the wheelchair. The wheelchair and user then exit the barrier-free shower.

Normally, shower curtains are used to act as a barrier to prevent water from escaping from the shower enclosure. Due to the relatively large opening of the shower enclosure, and the absence of a raised threshold, the shower curtain may tend to fly away from the enclosure due to the presence of pressurized water which heats the air within the shower during the shower activity. As a result, water escapes from the shower enclosure, and onto the floor in an undesired manner.

SUMMARY OF THE PRESENT INVENTION

The present invention provides a ramp which facilitates the positioning of the wheelchair from the floor of the bathroom, or other room, into the shower. The ramp may be pivoted to a closed position which is generally vertical, thereby holding the shower curtain in place as the shower is used. A dam extends generally vertically from the ramp when the ramp is resting against floor in the open position, and as the ramp is pivoted to the closed position, the dam covers the gap between the ramp and the threshold to return water to the shower and prevent water which strikes the ramp from running on to the floor. The dam is made of a flexible material which does not inhibit movement of the wheelchair. The pivoting of the ramp allows the ramp to be removed from the floor of the room for cleaning of the floor, and to prevent the ramp from inhibiting movement within the bathroom or other room.

DETAILED DESCRIPTION OF THE PREFERRED EMBODIMENT

Figure 1:
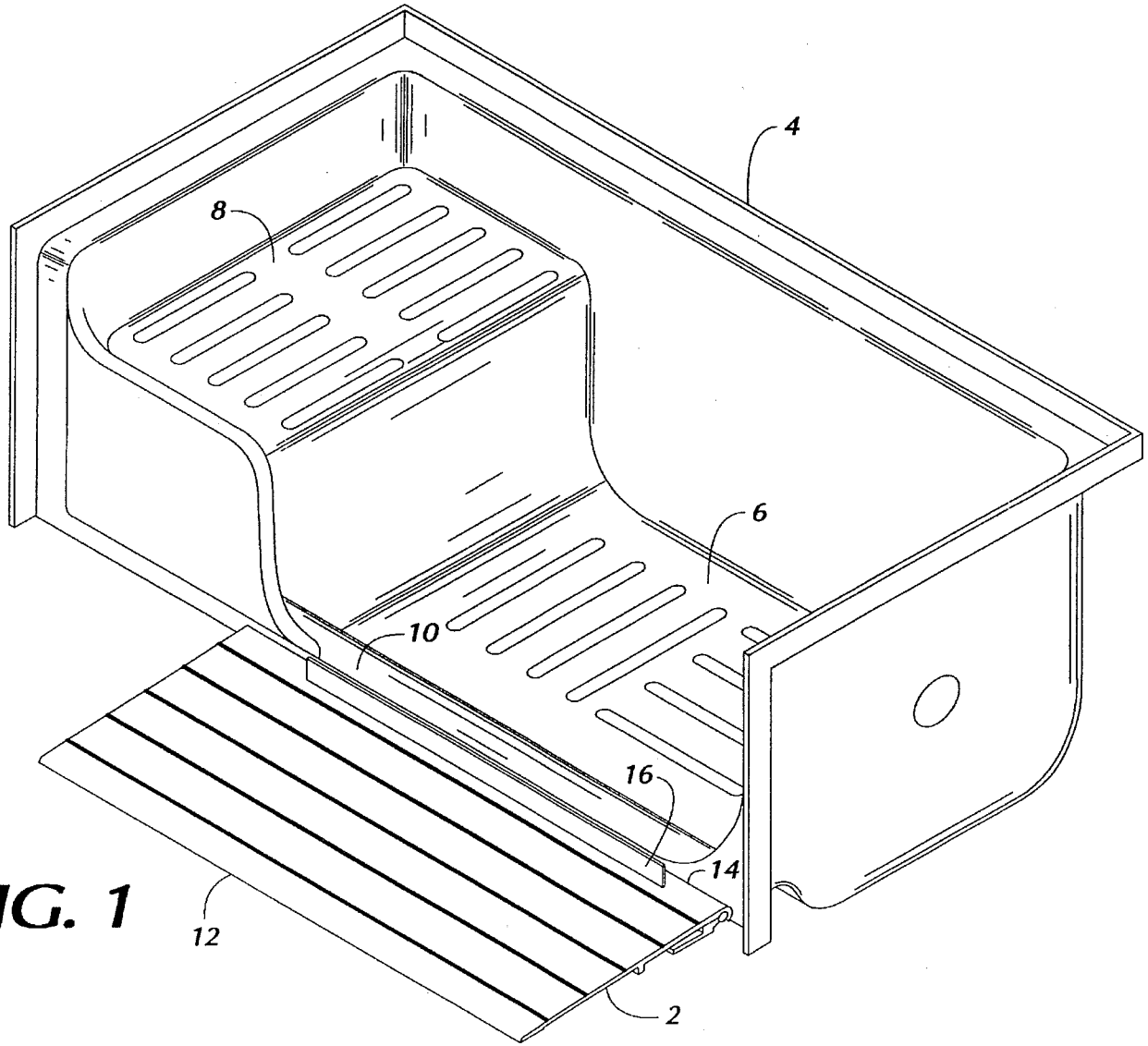
FIG. 1 is a perspective view of the ramp positioned adjacent to a shower.

Referring now to the drawing figures, FIG. 1 shows the ramp 2 positioned adjacent to the threshold of the barrier-free shower. The barrier-free 4 shower is shown as a modular unit, which could be made of plastic or fiberglass, for installation into a bathroom. Any other shower designed to accept wheel chairs within the shower could be used with the invention, and the shower could be constructed of any material from which such showers are normally constructed. The shower as shown in the drawing figure has an opening for ingress and egress of a wheelchair. The floor 6 of the shower allows adequately for positioning of the wheelchair. A seat 8 is provided for seating of a user of the shower after the user is taken from the wheelchair.

Figure 2:
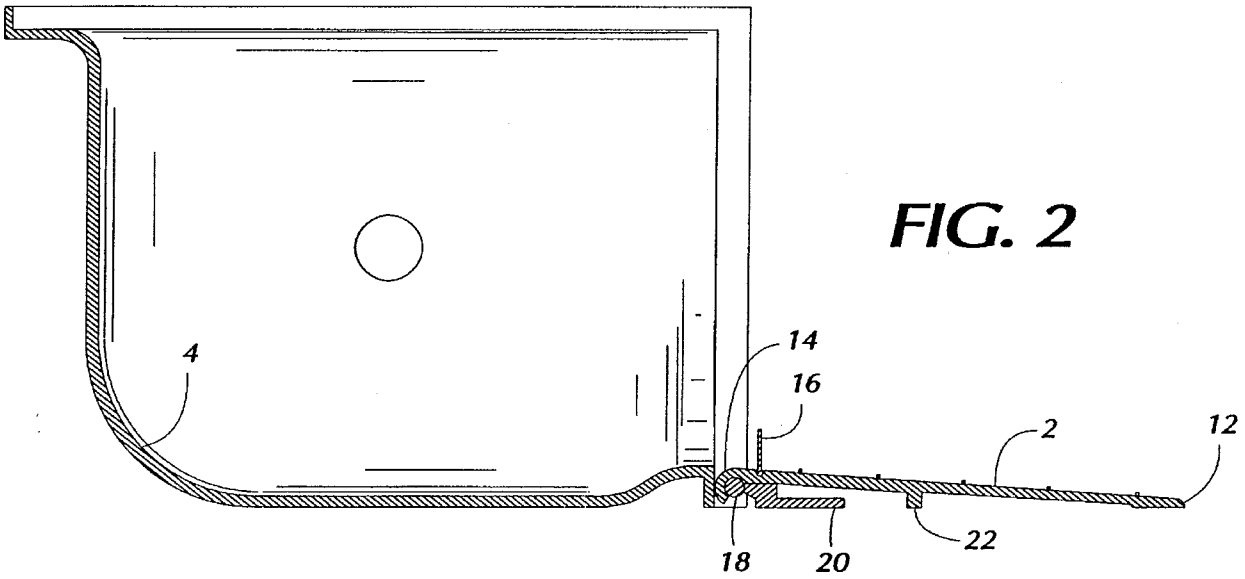
FIG. 2 is a sectioned view of the shower and ramp, with the ramp in the open position.

The nature of the shower is that the floor of the shower is higher than the floor on which the shower sits. The threshold 10 of the opening of the shower is somewhat elevated from the floor of the bathroom or other room, creating a barrier which must be overcome for placement of the wheelchair within the shower. The ramp aids in overcoming this barrier. The open position of the ramp is demonstrated by FIGS. 1 and 2. The ramp has a front edge 12 and rear edge 14. The rear edge of the ramp is adjacent to the threshold of the shower, while the front edge is generally parallel to, and opposite, the threshold and the rear edge. The ramp is characterized by an upward incline from the front edge to the rear edge, when the ramp is positioned so that the front edge is in contact with the floor.

The ramp has a dam 16 which extends generally vertically from the ramp when the ramp is in the open position. The dam is constructed of a material which will repel water, such as plastic, rubber or silicone. This dam should have sufficient rigidity to extend generally vertically as shown in drawing FIG. 2 when the ramp is the open position, while at the same time, the dam is highly flexible, and is easily displaced when a wheelchair is rolled over it, so that the dam offers substantially no resistance to the wheelchair as it rolls across the ramp. The dam is resilient, and regains its shape after it is displaced by the wheel chair.

Figure 3:
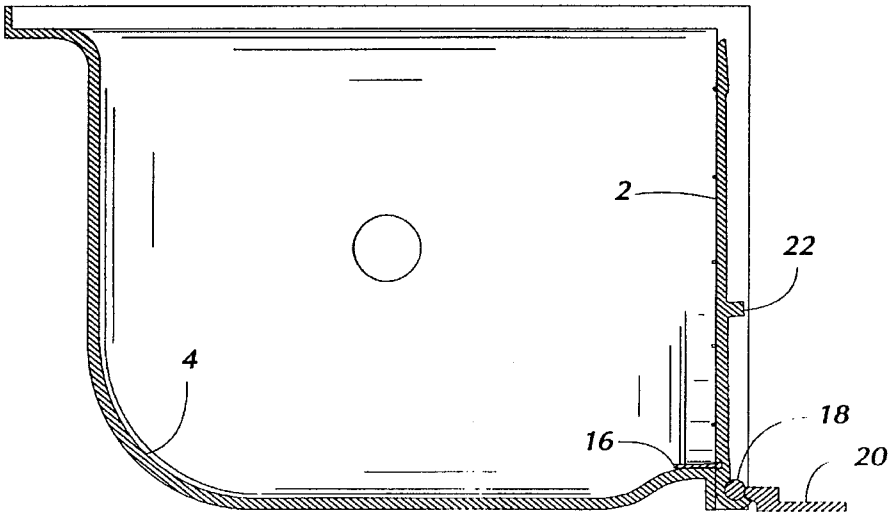
FIG. 3 is the sectioned view of FIG. 2, with the ramp in the closed position.

The ramp is provided with a pivoting means 18, such as a hinge. Pivoting means allows the ramp to be placed in the open position, with the front edge of the ramp against the floor, and to then be repositioned by pivoting to the closed position as shown in FIG. 3. The pivoting means could be any hinge or other pivoting means which will accomplish this function. In the preferred embodiment, the hinge has a plate 20 which is attached to the floor by fasteners or adhesives or the like. The hinge connects the plate to the ramp to allow the ramp to pivot.

The ramp is pivoted to the closed position, which postions the ramp generally vertically as shown in FIG. 3. If a shower curtain is used with the shower, the shower curtain will be positioned inside the shower, so as to cover the opening of the shower. As water and heated air tend to force the shower curtain outward from the shower, the ramp aids in retaining the shower curtain within the shower, thereby keeping water in the shower as desired.

As the ramp is pivoted to the closed position, the dam is positioned over a gap which is present between the ramp and the shower. As water from the shower strikes the ramp, or if water is present on the ramp for other reasons, such as the egress of the wet wheelchair, water which runs down the ramp will not fall between the ramp and the shower, but is diverted by the dam, which acts a sealing strip, back into the shower enclosure.

Accordingly, the dam is of sufficient height to cover the gap between the ramp and the enclosure when the ramp is pivoted to the closed position. The dam is of sufficient length to cover the length of the gap between the ramp and shower. The dam is positioned on the ramp generally parallel to the rear edge of the ramp and near the rear edge of the ramp, but offset from the rear of the ramp toward to the front of the ramp a sufficient distance to allow the dam to rest just over the threshold as shown in FIG. 3, when the ramp is in the closed position.

The ramp could be made of any suitable material which will perform the functions described above, and which will support the weight of a wheelchair with a person in the wheelchair. It is preferred that the ramp be constructed of a material which is not subject to corrosion when exposed to water. Materials such as fiberglass, aluminum, stainless steel and molded plastic are preferred. A support member 22 may be provided to increase structural rigidity of the ramp along its length. Non-skid material may be molded or fabricated in the ramp. Such non-skid material could be a series of peaks and/or valleys, or other corrugated structure. Non-skid material could be affixed, or attached, or painted onto the ramp in any known manner.

What is claimed is:

1. A ramp for use adjacent to a barrier free shower, comprising: a ramp having a front edge and a rear edge, means for mounting said ramp on a floor adjacent a threshold of a shower so as to provide an inclined surface from said floor to said threshold, wherein when said ramp is in an open position, said inclined surface extends from said front edge to said rear edge, and said rear edge is positioned adjacent to a threshold of a shower;

a dam which extends generally perpendicular from said inclined surface near said rear edge of said ramp when said ramp is in said open position; and means for pivoting said ramp from said open position to a closed position, wherein, when said ramp is in said closed position, said ramp is positioned generally vertically, and said dam covers substantially all of a gap between said ramp and said threshold of said shower.

2. A ramp for barrier-free showers as described in claim 1, wherein said ramp has a corrugated surface.

3. A ramp for barrier-free showers as described in claim 2, wherein a length of said dam is approximately equal to a length of said rear edge.

4. A ramp for barrier-free showers as described in claim 1, wherein said means for pivoting said ramp is a hinge which is positioned under said rear edge of said ramp and adjacent to said threshhold.

5. A ramp for barrier-free showers as described in claim 4, wherein a length of said dam is approximately equal to a length of said rear edge.

6. A ramp for barrier-free showers as described in claim 4, wherein said dam is comprised of a resilient material which will compress under a weight of a wheel chair, and will regain its shape when said weight is removed.

7. A ramp for barrier-free showers as described in claim 6, wherein a length of said dam is approximately equal to a length of said rear edge.

8. A ramp for barrier-free showers as described in claim 1, wherein said ramp has a non-skid surface.

9. A ramp for barrier-free showers as described in claim 8, wherein a length of said dam is approximately equal to a length of said rear edge.

10. A ramp for barrier-free showers as described in claim 1, wherein said dam is comprised of a resilient material which will compress under a weight of a wheel chair, and will regain its shape when said weight is removed.

11. A ramp for barrier-free showers as described in claim 10, wherein a length of said dam is approximately equal to a length of said rear edge.

12. A ramp for barrier-free showers as described in claim 1, wherein a length of said dam is approximately equal to a length of said rear edge.

* * * * *